US012623269B2

(12) United States Patent
Jung

(10) Patent No.: US 12,623,269 B2
(45) Date of Patent: May 12, 2026

(54) FIXING DEVICE FOR BENDING PROCESSING OF SHAFT- SHAPED MEMBER

(71) Applicant: DAEWON APPLIED ENG. CO., Gyeonggi-do (KR)

(72) Inventor: Chan Gi Jung, Incheon (KR)

( * ) Notice: Subject to any disclaimer, the term of this patent is extended or adjusted under 35 U.S.C. 154(b) by 0 days.

(21) Appl. No.: 19/033,163

(22) Filed: Jan. 21, 2025

(65) Prior Publication Data

US 2026/0008088 A1 Jan. 8, 2026

(30) Foreign Application Priority Data

Jul. 2, 2024 (KR) ..... 10-2024-0086728

(51) Int. Cl.
*B21D 7/04* (2006.01)
*B21D 7/024* (2006.01)

(52) U.S. Cl.
CPC ..... *B21D 7/04* (2013.01); *B21D 7/024* (2013.01)

(58) Field of Classification Search
CPC . B21D 7/02; B21D 7/024; B21D 7/04; B21D 11/22; B21D 43/10; B25B 1/20; B25B 5/147
See application file for complete search history.

(56) References Cited

U.S. PATENT DOCUMENTS

| | | | | |
|---|---|---|---|---|
| 4,215,602 | A * | 8/1980 | Carstensen | E21B 19/164 81/57.21 |
| 10,173,304 | B2 * | 1/2019 | Christofilis | B21D 7/16 |
| 2016/0311086 | A1 * | 10/2016 | Christofilis | F16B 2/18 |

FOREIGN PATENT DOCUMENTS

| | | | |
|---|---|---|---|
| JP | 2013111590 | A | 6/2013 |
| KR | 100204675 | B1 | 6/1999 |
| KR | 200367350 | Y1 | 11/2004 |
| KR | 1020060048847 | A | 12/2006 |
| KR | 102642618 | B1 | 3/2024 |

OTHER PUBLICATIONS

CN 118253614A, Ren et al. Jun. 2014.*
DE 102015122651A1, Schemel Jun. 2017.*
DE 102018124660A1, Lopez et al. Apr. 2020.*
KR 102642618B1, Jung Mar. 2024.*

* cited by examiner

*Primary Examiner* — Edward T Tolan
(74) *Attorney, Agent, or Firm* — Intellectual Property Consulting, LLC; Jared K. Rovira

(57) ABSTRACT

The present invention relates to a fixing device for bending processing of a shaft-shaped member, including a panel support member capable of sliding on an upper portion of a sliding rail, a fixed panel including a first opening having a semicircular shape, a tilting panel including a second opening having a semicircular shape symmetrical to the first opening and capable of tilting about a tilting shaft, a rotary plate having first and second rotary plates having semicircular cross-sectional shapes that are detachably coupled to each other and inserted to be rotatable inside the first and second openings, a drive gear that engages with a driven gear on an outer peripheral surface of the rotary plate, a first actuator that provides a rotational driving force to the drive gear, a second actuator mounted on the tilting panel to tilt the tilting panel, and a third actuator that slides the panel support member.

11 Claims, 14 Drawing Sheets

[FIG. 1]
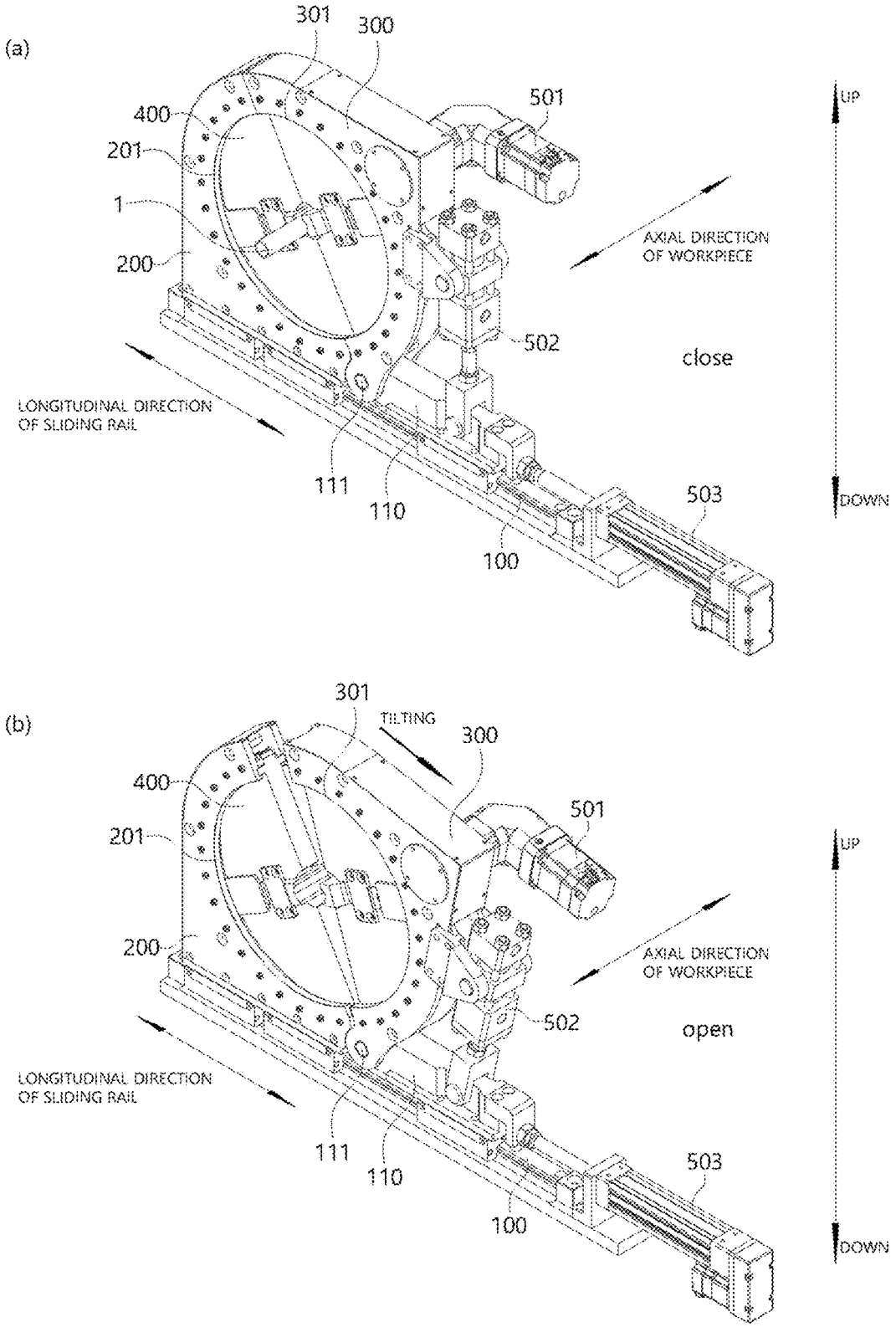

[FIG. 2]
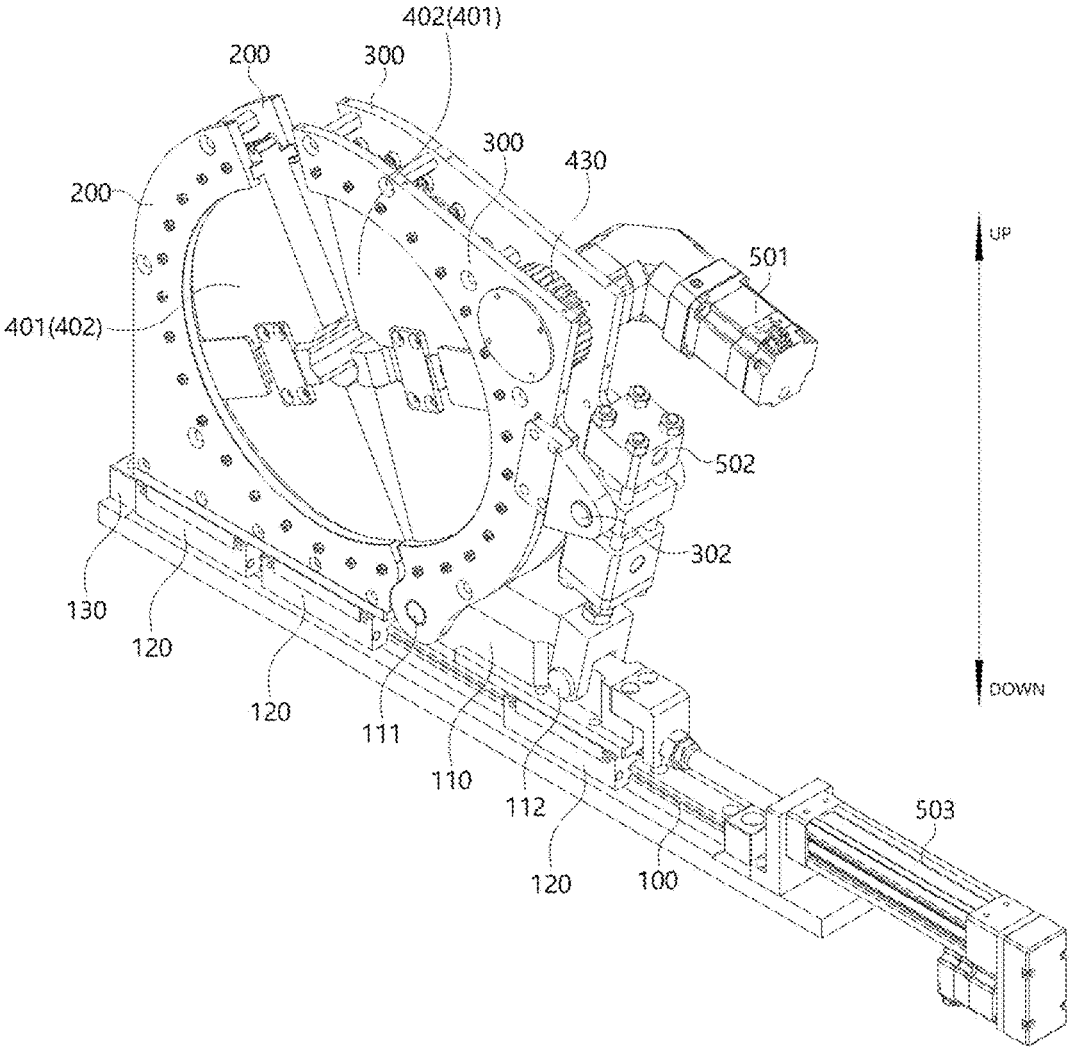

[FIG. 3]
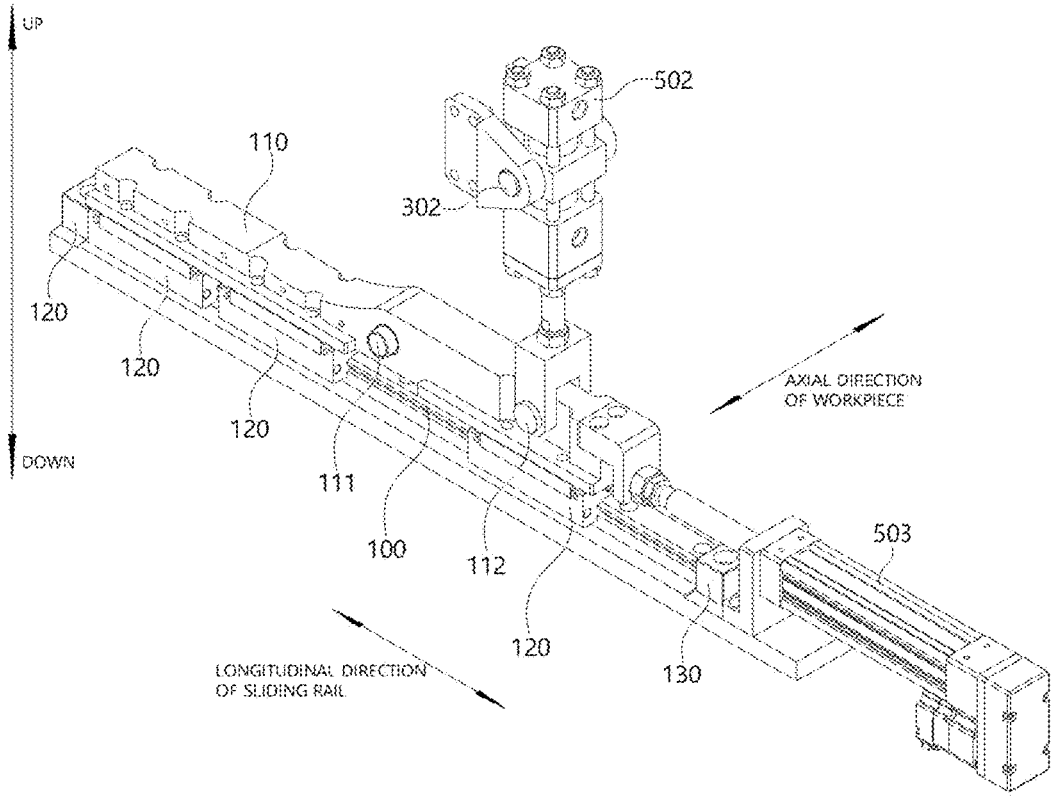

[FIG. 4]
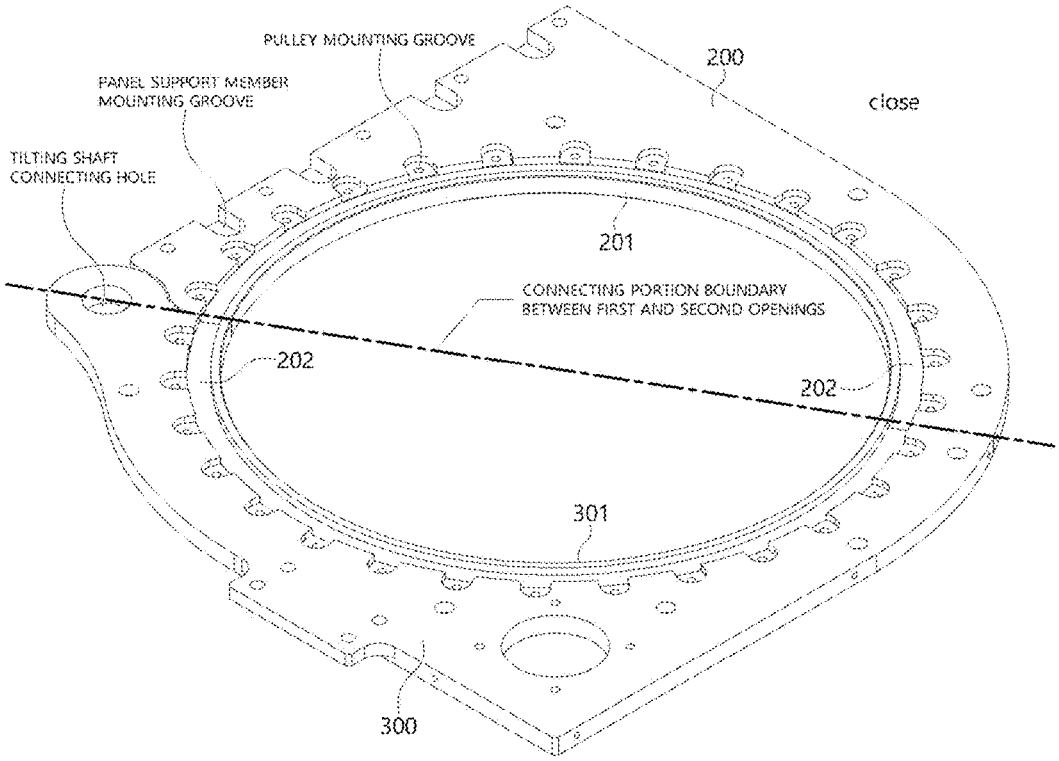

[FIG. 5]
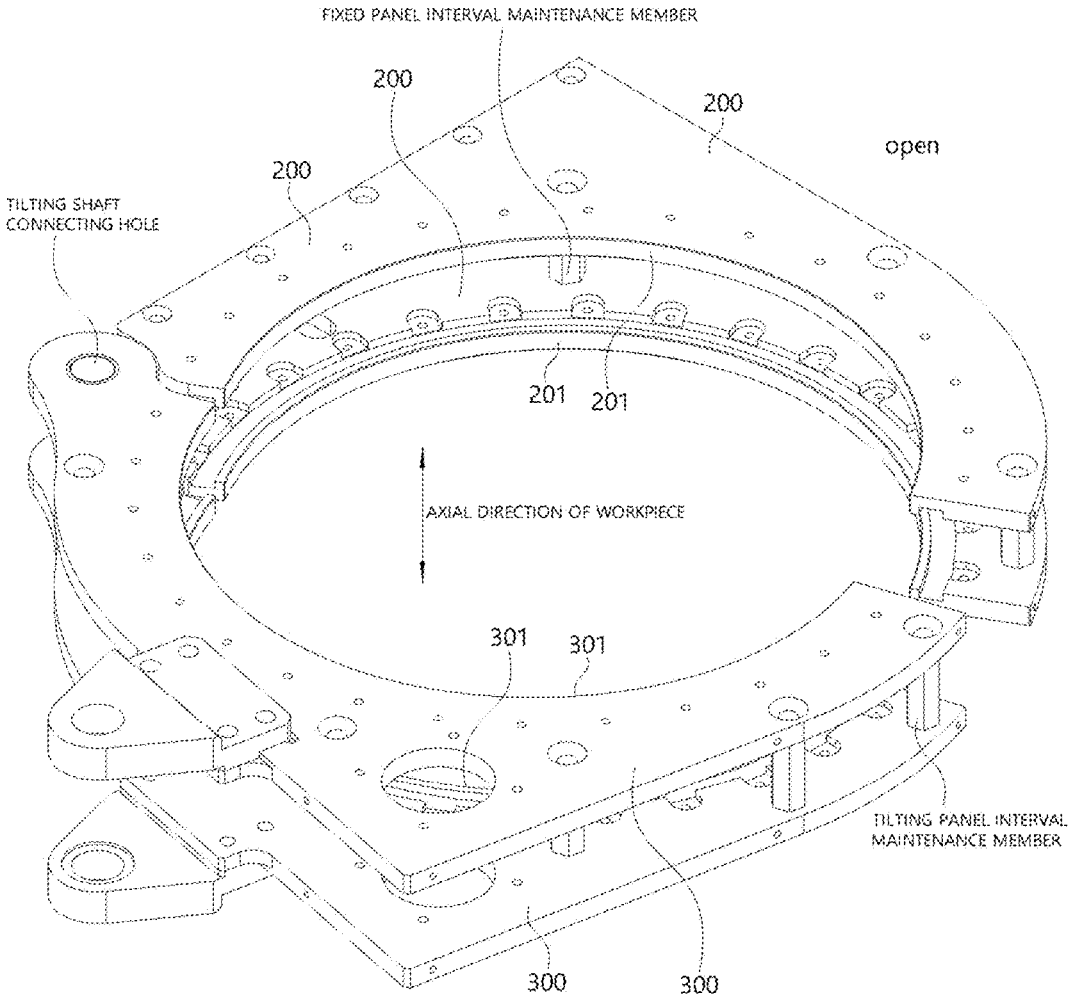

[FIG. 6]
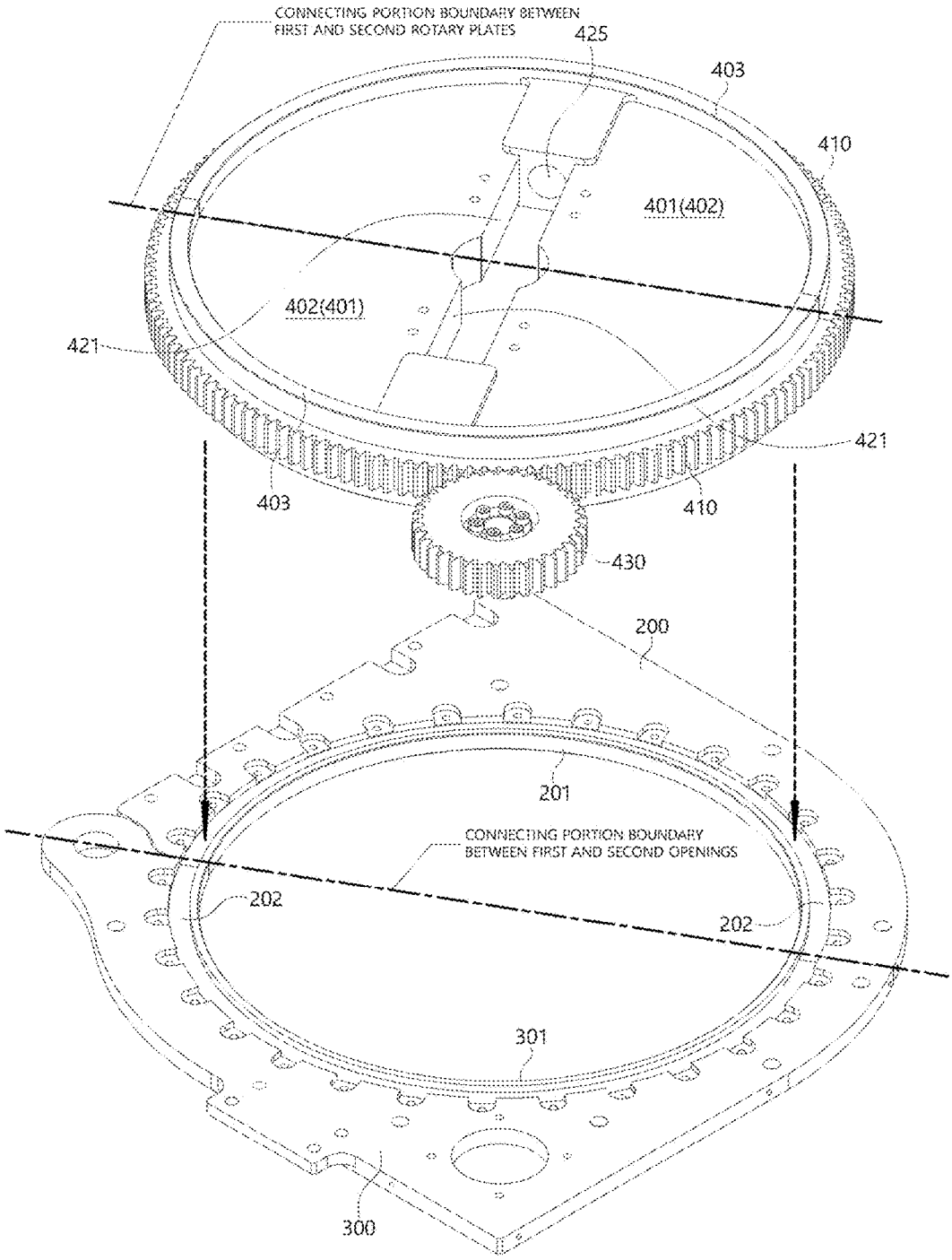

[FIG. 7]
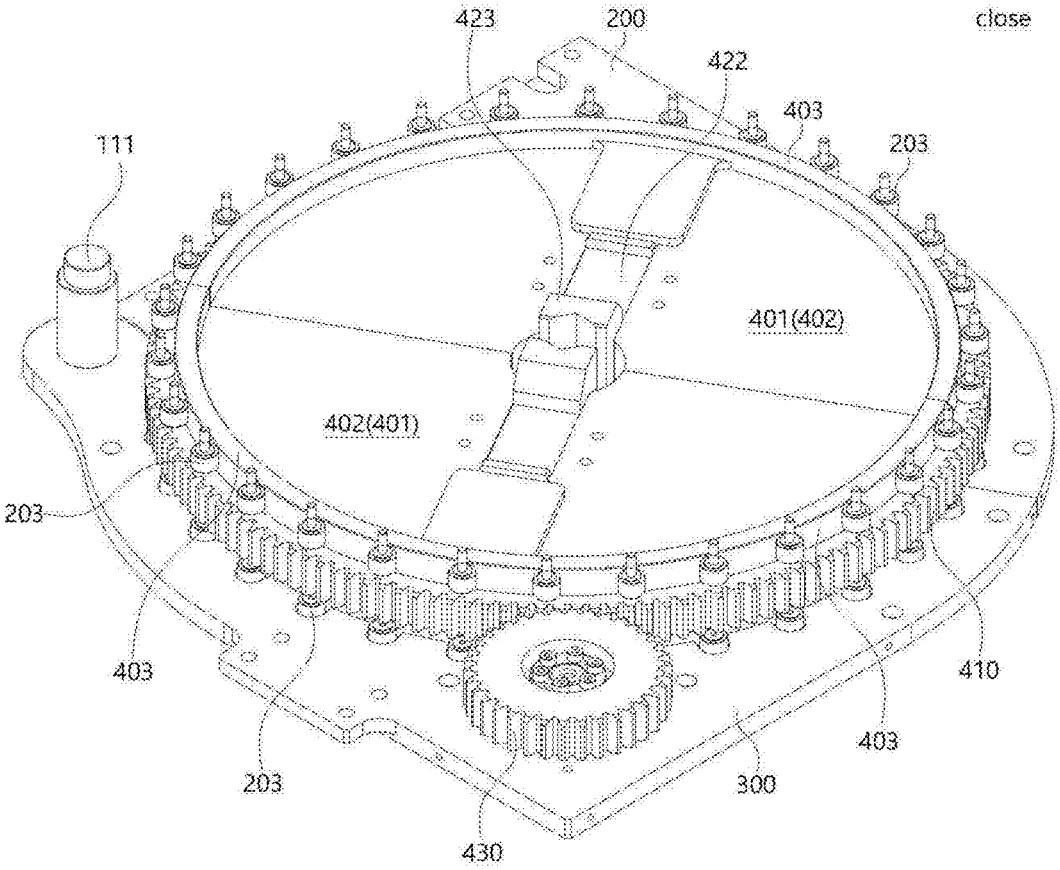

[FIG. 8]
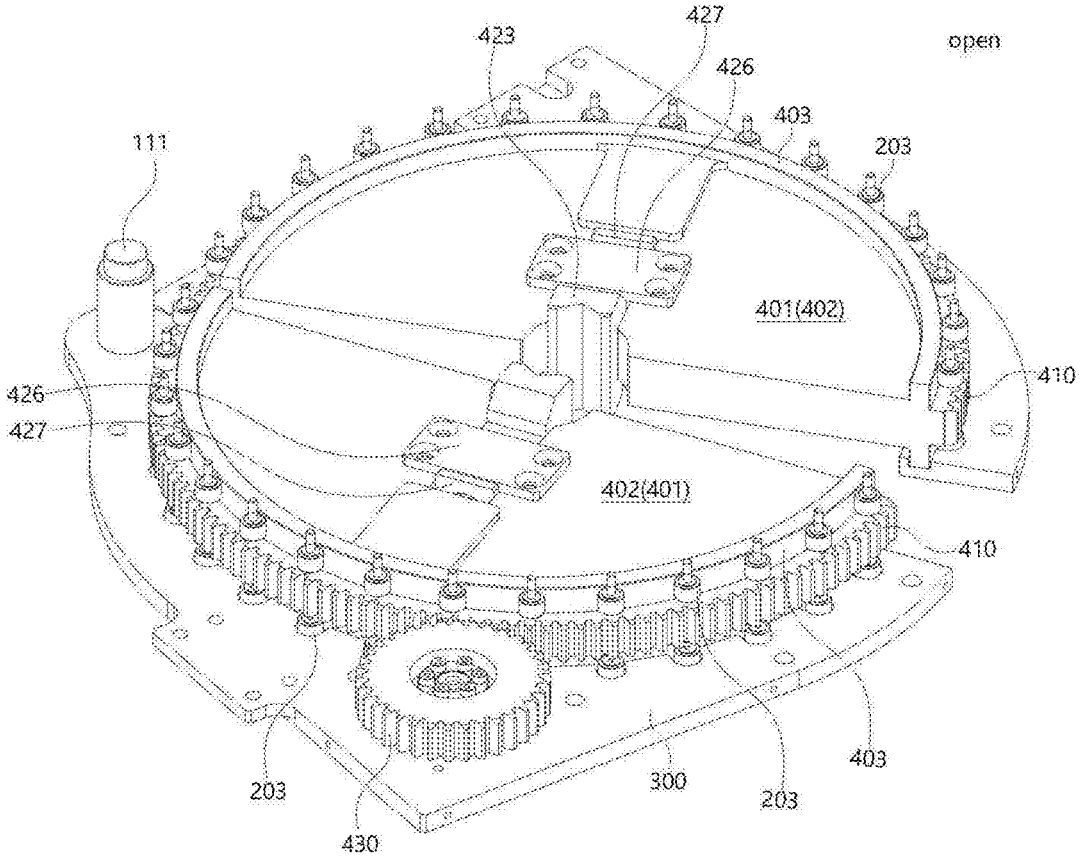

[FIG. 9]
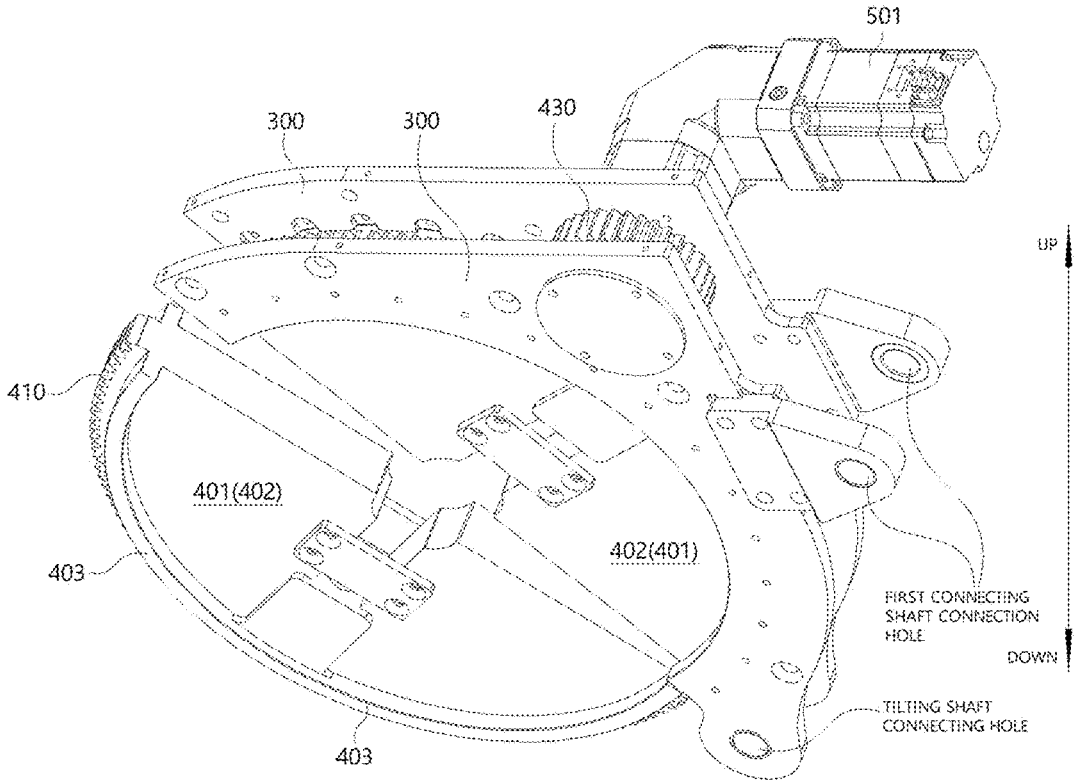

[FIG. 10]
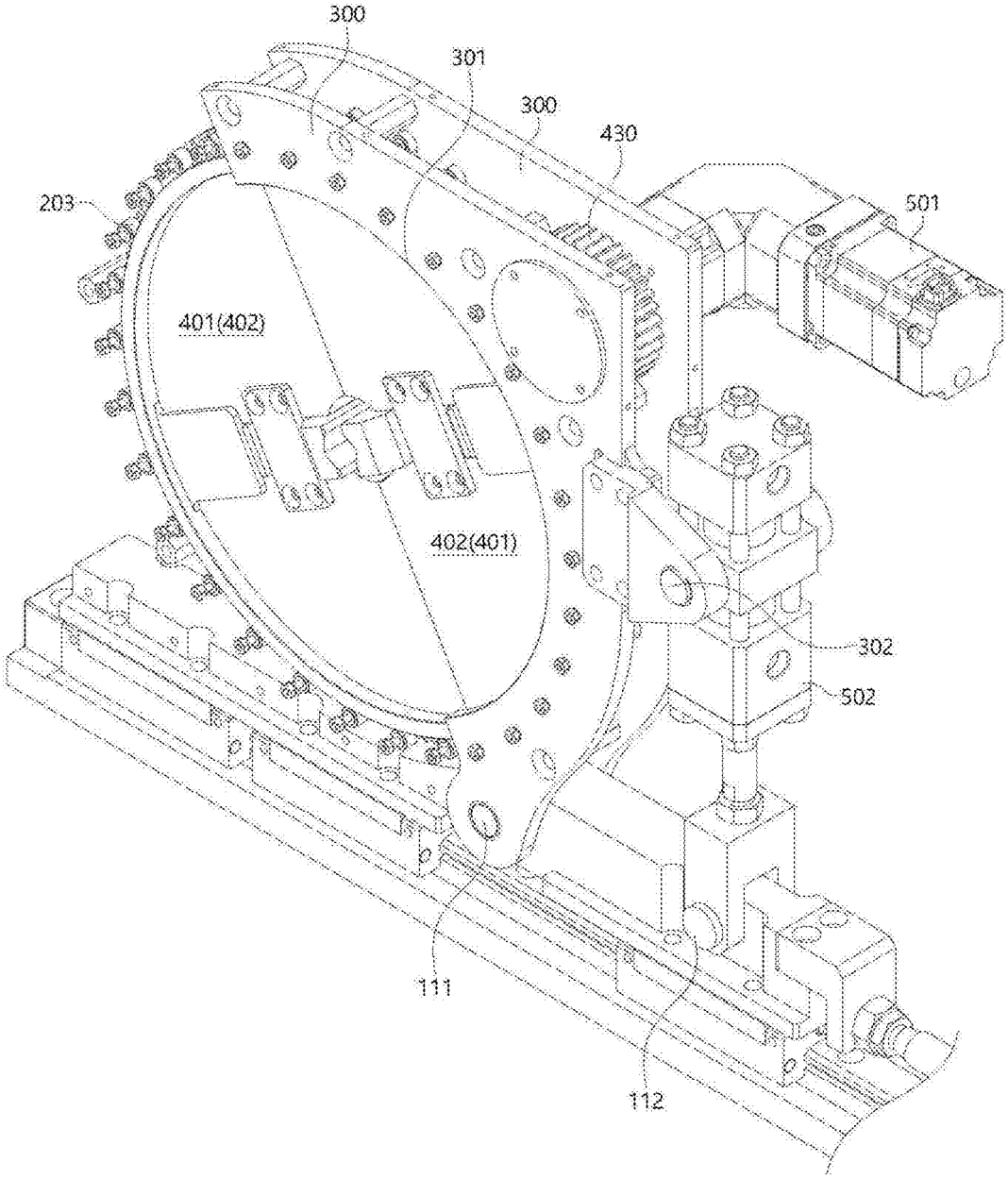

[FIG. 11]
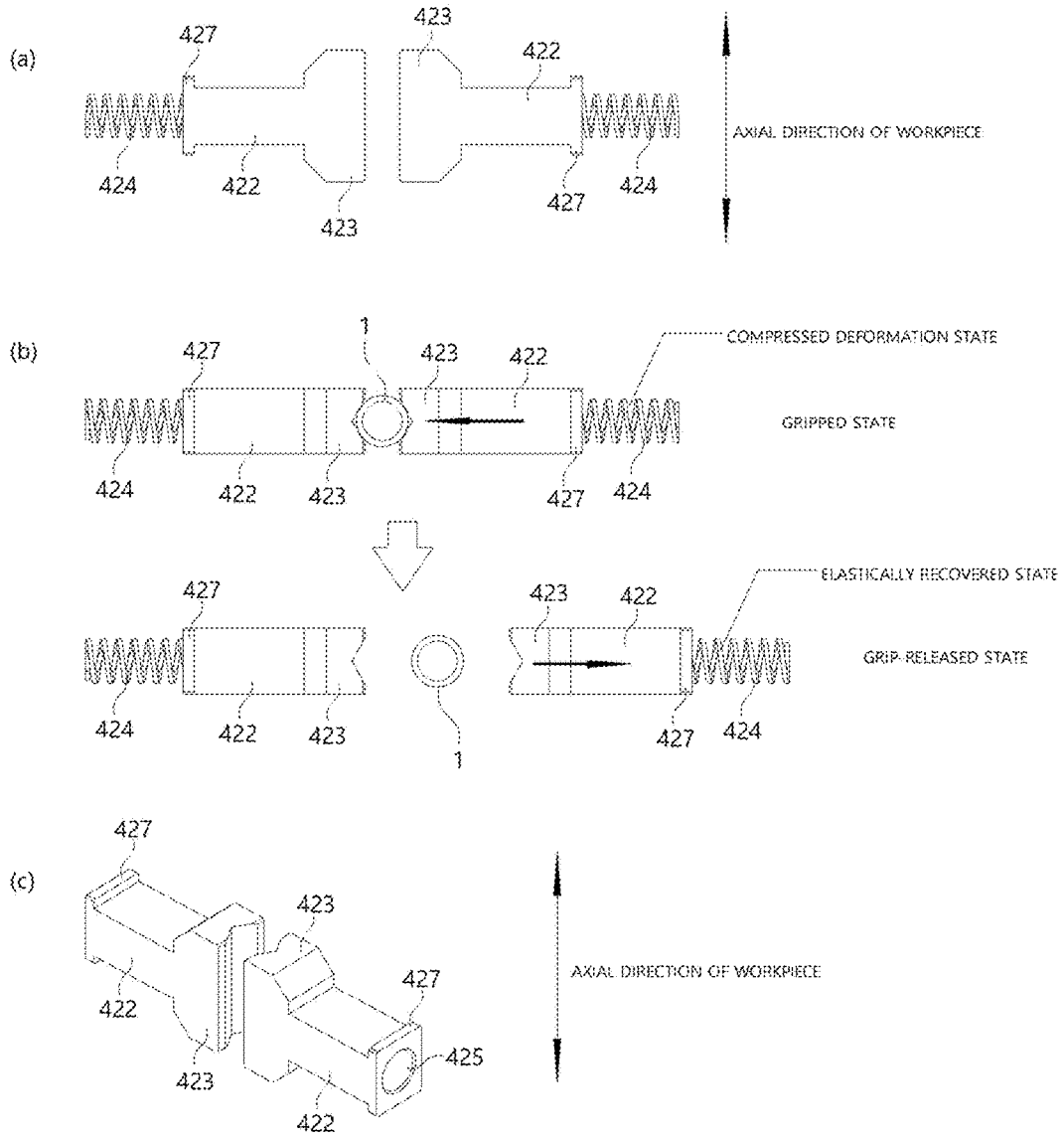

[FIG. 12]
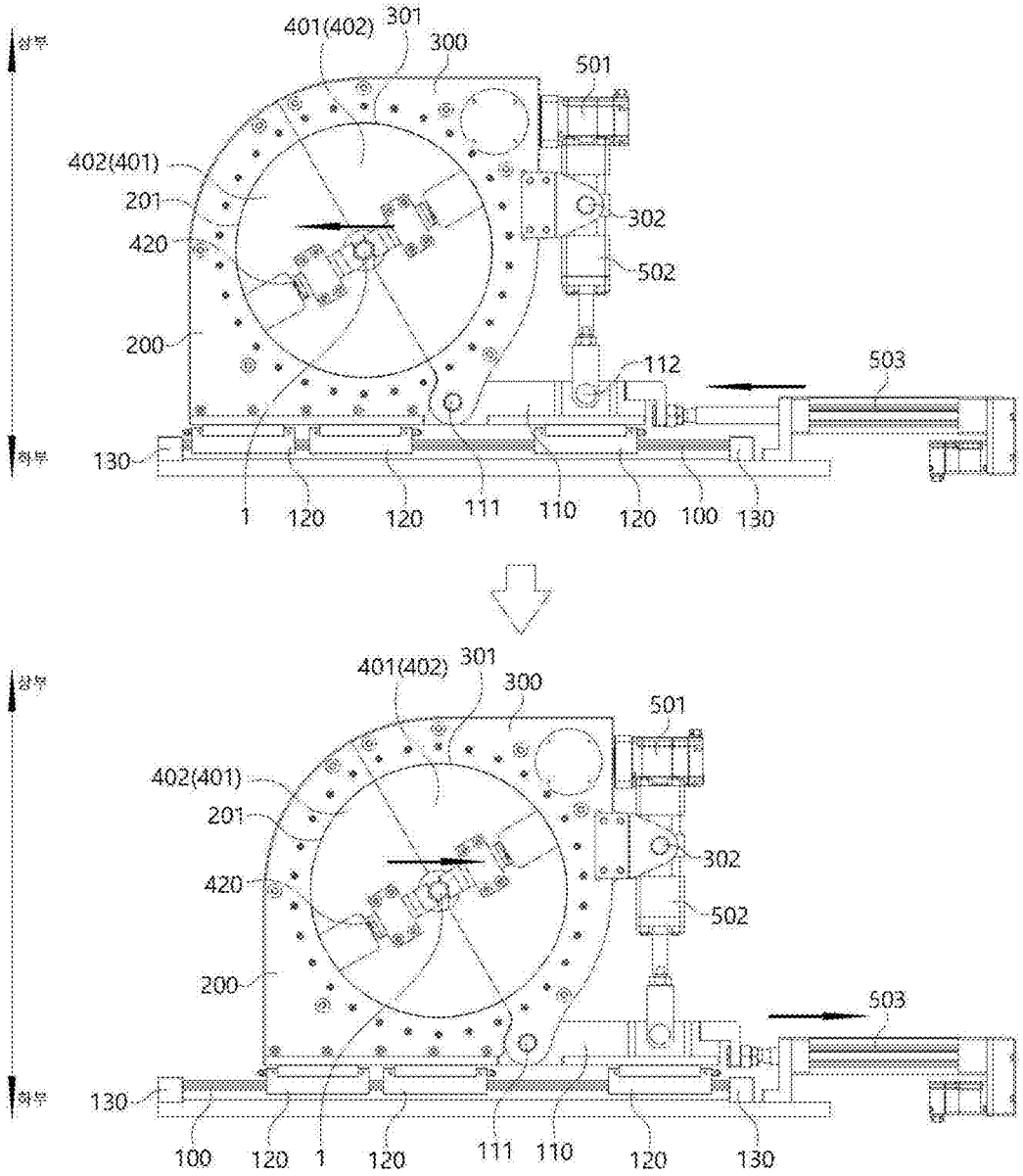

[FIG. 13]
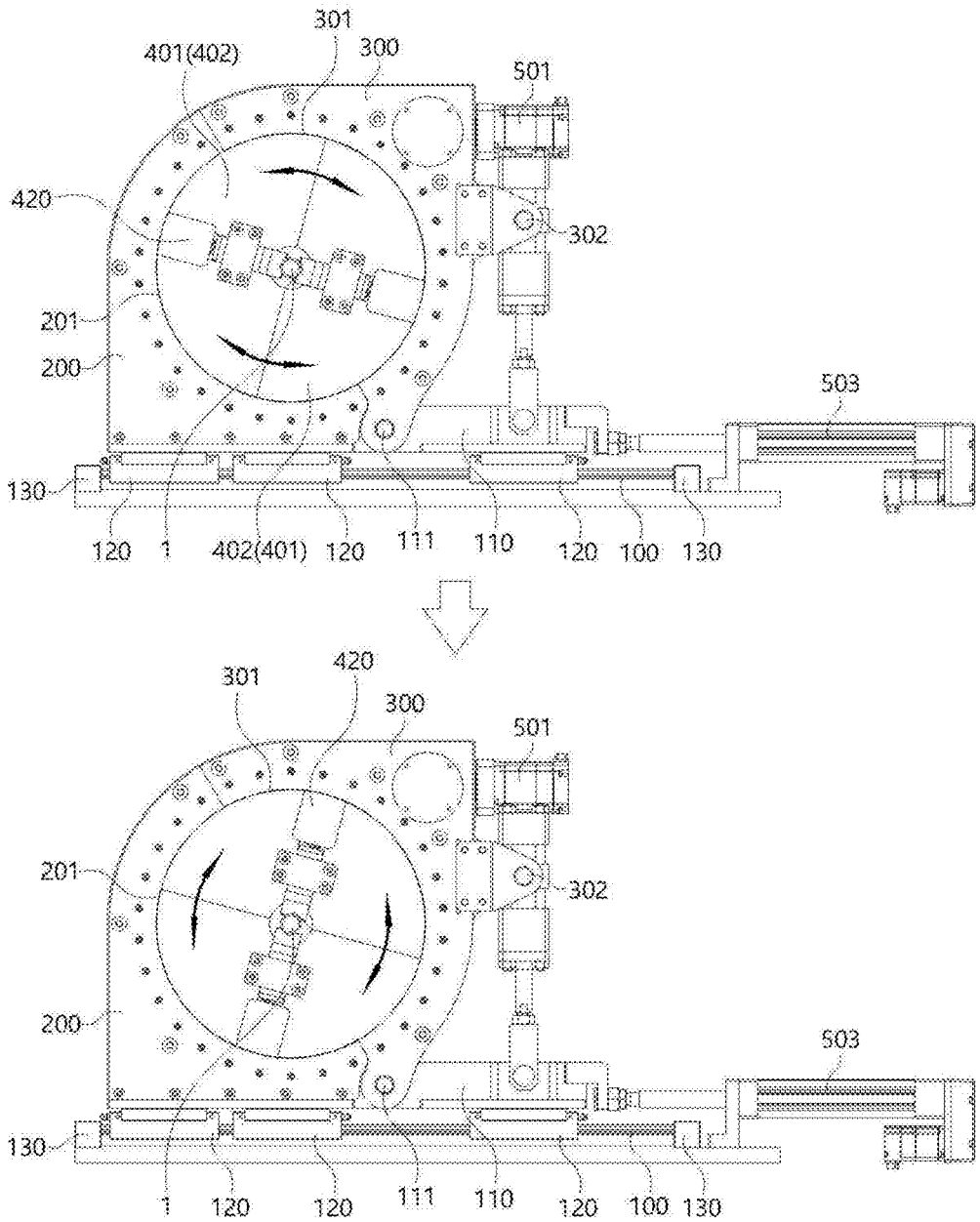

[FIG. 14]
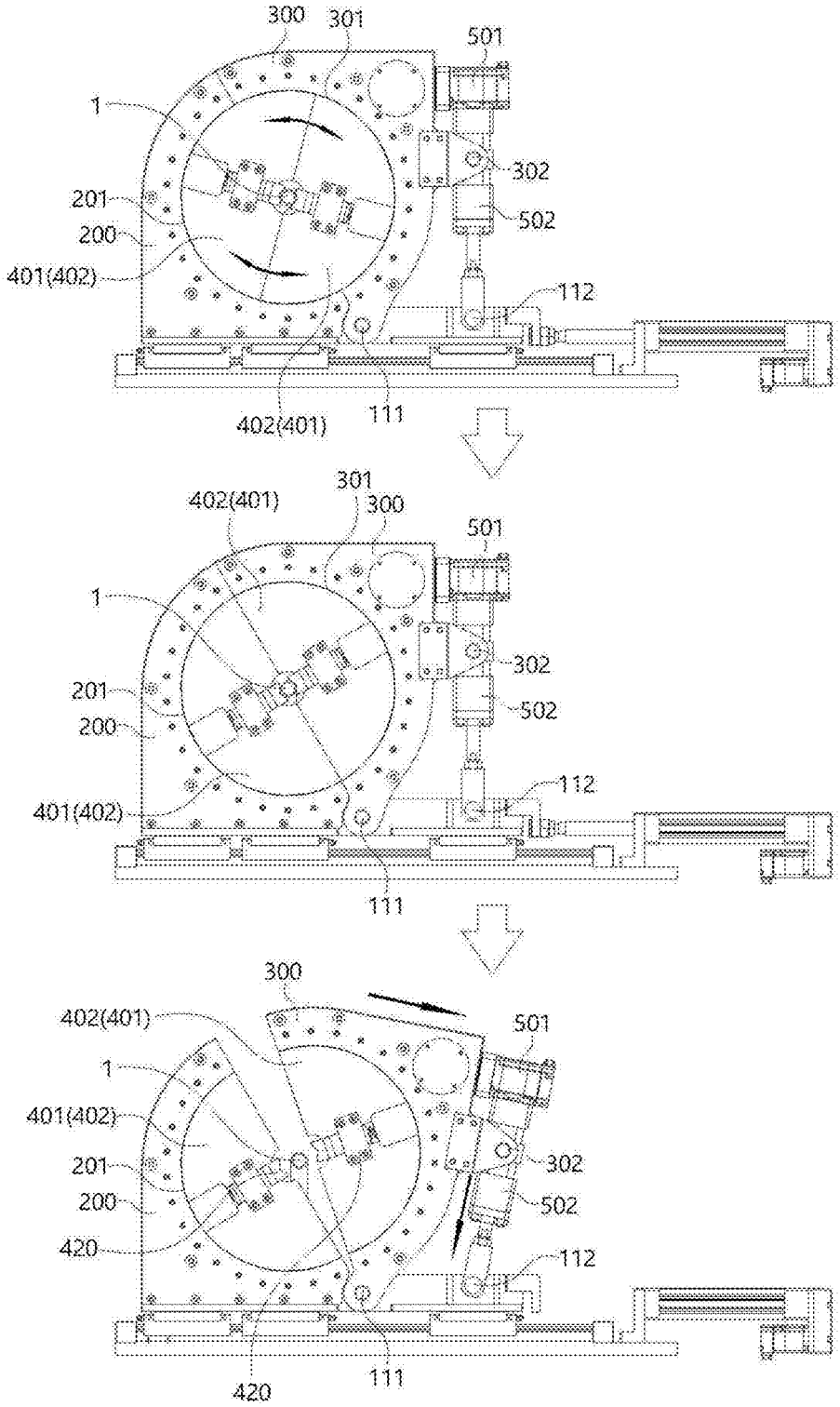

FIXING DEVICE FOR BENDING PROCESSING OF SHAFT- SHAPED MEMBER

CROSS-REFERENCE TO RELATED APPLICATION

This application claims priority to and the benefit of Korean Patent Application No. 10-2024-0086728, filed on Jul. 2, 2024, the disclosure of which is incorporated herein by reference in its entirety.

BACKGROUND

1. Field of the Invention

The present invention relates to a device for fixing a member for processing a shaft-shaped member, and more specifically, to a fixing device for bending processing of a shaft-shaped member, including a panel support member capable of sliding on an upper portion of a sliding rail, a fixed panel including a first opening having a semicircular shape, a tilting panel including a second opening having a semicircular shape symmetrical to the first opening and capable of tilting with respect to a tilting shaft, a rotary plate having first and second rotary plates having a semicircular cross-sectional shape that are detachably coupled to each other and inserted to be rotatable inside the first and second openings, a drive gear that engages with a driven gear on an outer peripheral surface of the rotary plate, a first actuator that provides a rotational driving force to the drive gear, a second actuator mounted on the tilting panel to tilt the tilting panel, and a third actuator that slides the panel support member.

2. Discussion of Related Art

A bending processing device for processing a finished product in the shape of a shaft in which a bending portion is formed includes a guide in the shape of a disk and a jig positioned opposite an outer peripheral surface of the guide, and bending processing is performed by disposing one side of a workpiece made of a rod or pipe having a circular cross-section between the guide and the jig, and then pressing the other side of the workpiece toward the jig while changing a jig disposition position according to a shape of a bending portion or a bending angle of the finished shaft-shaped product.

During the bending processing of the workpiece, one side of the workpiece is fixed by a fixing device, and when the workpiece is not properly fixed by the fixing device, a fixing point of the workpiece may move in an axial direction or a direction in which bending occurs due to an external force to cause an error in a position of the bending portion or the angle at which the bending portion is bent, and thus the shape precision of the finished shaft-shaped product may be significantly lowered.

As the fixing device for firmly fixing and supporting the workpiece during the bending processing, in a bending processing device for a shaft-shaped member of Korean Patent Registration No. 10-2642618 (registered on Feb. 27, 2024), a fixing device including a jig fixing block installed vertically upward, a chucking jig transfer unit that adjusts a chucking jig position in a transverse direction perpendicular to a longitudinal direction of the workpiece, a chucking jig mounted on the chucking jig transfer unit, and a chucking jig rotation unit that axially rotates the workpiece fixed to the chucking jig is presented.

The chucking jig rotation unit of the fixing device is formed as a disk-shaped member between a pair of chucking panels having a circular opening formed toward one side of a central portion, a chucking disk having a rotation angle controlled by a member rotation motor is rotatably mounted thereon, and the chucking disk is configured to be equipped with a pair of grip portions for fixing the sides of the workpiece and actuators for controlling gripping or releasing of the workpiece of each grip portion.

Accordingly, in a state where the workpiece is fixed through the grip portions, the rotation angle of the chucking disk is controlled according to the shape of the bending portion of the shaft-shaped member to rotate the workpiece in the axial direction, thereby changing the direction of the bending processing of the workpiece.

In the configuration of the fixing device capable of controlling the direction of bending of the workpiece through the chucking disk, a grip state of the workpiece through the grip portion may not be released for changing the direction of bending processing of the workpiece, thereby significantly improving the speed of performing bending processing of the workpiece.

However, a grip structure of the fixing device that controls the gripping or releasing of the workpiece through the actuator as described above increases an axial thickness of the workpiece of the fixing device as the actuators for controlling the grip portion, which are made of an air cylinder or a hydraulic cylinder, are added.

Accordingly, as a non-processable region in which bending processing is not able to be performed increases in the axial direction of the workpiece while being fixed to the fixing device, a distance in which the guide and jig of the bending device are allowed to approach the fixing device is limited, so that a minimum bendable length of the workpiece may increase, and the shape or size of the finished shaft-shaped product capable of being bent may be limited.

In addition, in the grip structure of the fixing device as described above, in order to grip and fix the workpiece to perform the bending processing, or in order to release the grip to separate the workpiece that has undergone bending processing from the fixing device, the grip state of the grip portions has to be controlled by operating the actuators.

In this case, in order to prevent damage or deformation of the surface of the fixing portion of the workpiece due to an excessive gripping force, or in order to prevent movement of the fixing point of the workpiece due to an insufficient gripping force, the operation of the actuator has to be precisely controlled, so that during an actuator operation control process, an operating time required for a process of gripping the workpiece increases, and thus there is a problem that the speed of the bending processing operation is slow.

Examples of the related art include Korean Patent Registration No. 10-2642618.

SUMMARY OF THE INVENTION

The present invention is directed to providing a fixing device structure capable of lowering a minimum bendable length limit of a workpiece and easing shape or size limits of a finished shaft-shaped product capable of being bent by reducing an axial thickness of the workpiece of the fixing device to lower a maximum approachable distance in which a guide and a jig of a bending device are movable toward the fixing device.

The present invention is also directed to providing a fixing device structure capable of improving the efficiency of bending processing work by reducing a time required for a process of gripping and releasing a workpiece of a fixing device.

According to an aspect of the present invention, there is provided a fixing device for bending processing of a shaft-shaped member, including a sliding rail disposed in a direction perpendicular to an axial direction of a workpiece having a shaft shape, a panel support member disposed on an upper side of the sliding rail to be slidable in a longitudinal direction of the sliding rail, a fixed panel including a pair of plate-shaped members fixedly disposed on one side of the panel support member to be spaced a certain interval apart in the axial direction of the workpiece and a first opening formed so that an edge facing the other end of the panel support member is recessed to form a semicircle, a tilting shaft mounted parallel to the axial direction of the workpiece at a center of the panel support member, a tilting panel including a pair of plate-shaped members disposed in the other direction of the panel support member to be spaced a predetermined interval apart in the axial direction of the workpiece, including a second opening formed to be recessed in a semicircular shape in which an edge facing one end of the panel support member on one side is symmetrical to the first opening, and having a lower end toward the second opening connected to be tiltable around the tilting shaft, a rotary plate having a circular disk shape formed by detachably coupling first and second rotary plates of a semicircular cross-sectional shape to each other to be inserted to be rotatable around the axial direction of the workpiece inside the circular openings formed by the first and second openings, having a driven gear formed on an outer peripheral surface thereof, and having a clamp formed to fix an outer peripheral surface of the workpiece to a semicircular central edge of each of the first and second rotary plates, a drive gear configured to engage with the driven gear on the outer peripheral surface of the rotary plate, a first actuator configured to provide a rotational driving force to the drive gear to rotate the workpiece fixed to the rotary plate and the clamp, a second actuator mounted on the tilting panel and configured to tilt the tilting panel around the tilting shaft to open or close a boundary portion between the first and second openings, and a third actuator mounted at an end of the panel support member and configured to cause the panel support member to slide in the longitudinal direction of the sliding rail.

According to an embodiment of the present invention, the bending processing may be performed when the workpiece fixed to the clamp moves in the longitudinal direction of the sliding rail by operating the third actuator or rotates and moves at the same time by operating the first and third actuators in a state where the boundary portion between the first and second openings is closed, the workpiece may be fixedly mounted on or separated from the clamp in a state where the boundary portion between the first and second openings is open, and an operation of opening or closing the boundary portion between the first and second openings may be performed by operating the second actuator in a state where the rotary plate is rotated so that a connecting portion boundary between the fixed panel and the tilting panel and a connecting portion boundary between the first and second rotary plates are disposed on the same plane by operating the first actuator.

According to an embodiment of the present invention, in a state where the boundary portion between the first and second openings is closed, a connecting portion boundary between the fixed panel and the tilting panel may be inclined so that an interval from the tilting shaft in the longitudinal direction of the sliding rail increases toward an upper side from a lower side, and a lower edge of the tilting panel may form an inclined surface in which an interval from an upper surface of the panel support member increases as the lower edge is further away from the tilting shaft.

According to an embodiment of the present invention, the clamp may include a sliding groove formed at each of the semicircular central edges of the first and second rotary plates and formed as a groove formed to be recessed into the outer peripheral surface of the rotary plate, a pair of sliding bars inserted into the sliding grooves of the first and second rotary plates to slide in the sliding grooves, and having a grip portion formed at ends of central portions of the first and second rotary plates to fix the workpiece, and an elastic member having both ends fixed to an inner surface of each of the sliding grooves of the first and second rotary plates facing each other and an end of the sliding bar, and configured to biasedly move each sliding bar toward the central portions of the first and second rotary plates.

According to an embodiment of the present invention, a rotation guide groove recessed to form a circular ring shape in a state where the first and second openings are closed may be formed in one or both of inner surfaces facing each other between the fixed panel and the tilting panel, and a rotation guide rim that protrudes to form a semicircular ring shape and is rotatably inserted into the rotation guide groove may be formed on each of surfaces of the first and second rotary plates facing the rotation guide groove.

According to an embodiment of the present invention, an upper end of the second actuator may be rotatably connected to a first connecting shaft mounted on an edge of the tilting panel facing the third actuator, and a lower end of the second actuator may be rotatably connected to a second connecting shaft mounted on the panel support member to be disposed between the tilting shaft and the third actuator. According to an embodiment of the present invention, sliders coupled to be slidable on the sliding rail may be fixedly mounted on a lower surface of the panel support member.

According to an embodiment of the present invention, the sliding grooves of the first and second rotary plates may form a concave groove shape that is open in the axial direction of the workpiece, an elastic member fixing groove in the shape of a concave groove into which an end of the elastic member may be inserted and fixed is formed in surfaces of ends of each sliding bar and the sliding groove facing each other, and a guide panel configured to close an open portion of the sliding groove and guide a moving direction of the sliding bar may be mounted on each of surfaces of the first and second rotary plates in the axial direction of the workpiece. According to an embodiment of the present invention, a number of pulleys may be rotatably mounted on an outer side of a surface forming the rotation guide groove of the fixed panel or the tilting panel to be spaced a certain interval from a center of the rotation guide groove and radially disposed, and an outer peripheral surface of each pulley may support an outer peripheral surface of the rotation guide rim.

According to an embodiment of the present invention, stoppers for limiting a movement distance of the panel support member may be formed at both ends of the sliding rail in the longitudinal direction.

According to an embodiment of the present invention, a clamp stopper may be formed at an end of a formation portion of the elastic member fixing groove of the sliding bar so that a portion of a surface of the sliding bar protrudes in the axial direction of the workpiece, and a catch may occur between the clamp stopper and the guide panel when the elastic member is stretched by elastic restoration.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a view showing opening and closing operation states of a rotary plate of a fixing device according to an embodiment of the present invention and directions defined to describe positional relationships between components of the fixing device;

FIG. 2 is a view showing an overall structure of the fixing device according to the embodiment of the present invention;

FIG. 3 is a view showing a connecting structure of a sliding rail and a panel support member according to the embodiment of the present invention;

FIG. 4 is a view showing an inner structure and a shape of a fixed panel and a tilting panel according to the embodiment of the present invention;

FIG. 5 is a view showing an opposite disposition structure in which the fixed panel and the tilting panel according to the embodiment of the present invention are spaced a predetermined interval apart;

FIG. 6 is a view showing a structure and a shape of a coupling surface between the fixed panel, the tilting panel, and the rotary plate according to the embodiment of the present invention;

FIGS. 7 and 8 are views showing rotary plate support structures through pulleys in closed and open operation states of the rotary plate according to the embodiment of the present invention;

FIG. 9 is a view showing a structure of the coupling surface of the rotary plate according to the embodiment of the present invention;

FIG. 10 is a view showing a rotary plate support structure through pulleys of the fixing device according to the embodiment of the present invention;

FIG. 11 is a view showing the structure of a sliding bar and a grip operation through a clamp according to the embodiment of the present invention;

FIG. 12 is a view showing a process of processing a workpiece according to movement of a sliding rail of the fixing device according to the embodiment of the present invention in a longitudinal direction;

FIG. 13 is a view showing a process of processing a workpiece according to the rotational operation of the rotary plate of the fixing device according to the embodiment of the present invention; and FIG. 14 is a view showing a process of aligning a connecting portion boundary between the rotary plate and the fixed and tilting panels for mounting or detaching a workpiece in the fixing device according to the embodiment of the present invention, and a process of opening and closing the rotary plate according to the tilting of the tilting panel.

DETAILED DESCRIPTION OF EXEMPLARY EMBODIMENTS

Hereinafter, embodiments of the present invention will be described in detail with reference to the accompanying drawings.

Parts necessary for understanding the operation and function according to the present invention will be described in detail.

In describing embodiments of the present invention, description of technical content that is well known in the technical field to which the present invention belongs and is not directly related to the present invention is omitted.

This is to more clearly convey the gist of the present invention without obscuring the gist by omitting unnecessary description.

In addition, in describing components of the present invention, different reference numerals may be given to components having the same name in different drawings, or the same reference numerals may be given even in different drawings.

However, even in such cases, this does not mean that the components have different functions in different embodiments, or that the components have the same function in different embodiments, and the function of each component should be determined based on the description of each component in a corresponding embodiment.

Further, the terminology used herein should be construed with meanings generally understood by those skilled in the art to which the present invention belongs unless specially defined otherwise, and should not be construed with excessively general meanings or excessively narrow meanings.

In addition, singular forms used herein include plural forms unless the context clearly indicates otherwise.

In the present application, the terms "consisting of," "comprising," or the like should not be construed as necessarily including all of various components or various operations described herein, and should be construed as not including some of the components or some of the operations, or including additional components or operations.

As shown in FIGS. 1 and 2, a fixing device 10 for bending processing of a workpiece 1, which is a shaft-shaped member, according to the present invention includes a sliding rail 100 fixedly installed on a floor surface, a panel support member 110 disposed on the sliding rail 100, fixed and tilting panels 200 and 300 mounted on the panel support member 110 to be openable and closable, a rotary plate 400 disposed between the fixed and tilting panels 200 and 300, and an actuator that controls the movement of the panel support member 110, opening and closing operations of the tilting panel 300, and the rotational drive of the rotary plate 400.

In the specification of the present invention, a longitudinal direction of a workpiece 1 that forms a circular outer peripheral surface or inner peripheral surface, such as a rod or pipe, and whose axial length is formed to be greater than its diameter is defined as an axial direction of the workpiece 1 in the description of the connection or disposition relationships between the components of the fixing device 10.

In addition, a direction in which an upper structure including the panel support member 110, the fixed and tilting panels 200 and 300, and the rotary plate 400 slides while perpendicular to the axial direction of the workpiece 1 and parallel to the floor surface is defined as a longitudinal direction of the sliding rail 100 in the description of the connection or disposition relationships between the components of the fixing device 10.

As shown in FIG. 3, the sliding rail 100 is formed of a rod-shaped member in which a width of the sliding rail 100 in the longitudinal direction is formed to be larger than a width of the workpiece 1 in the axial direction, and a cross-sectional shape thereof is formed so that a size of the width of the workpiece 1 of the upper sliding rail 100 in the axial direction is larger than a size of the width of the workpiece 1 of the lower sliding rail 100 in the axial direction.

In a connecting portion of the upper structure mounted on the sliding rail 100 with the sliding rail 100, a rail groove having a cross-sectional shape complementary to a cross-sectional shape of the sliding rail 100 is formed, thereby preventing the upper structure from being detached or separated from the sliding rail 100 during a process of sliding in the longitudinal direction of the sliding rail 100.

The sliding rail 100 is disposed on the floor surface in a direction perpendicular to the axial direction of the workpiece 1, and the panel support member 110 is disposed on an upper portion of the sliding rail 100 to be slidable in the longitudinal direction of the sliding rail 100.

A plurality of sliders 120 are fixedly mounted on a lower surface of the panel support member 110, and a rail groove having a cross-sectional shape complementary to the cross-sectional shape of the sliding rail 100 is formed in the longitudinal direction of the sliding rail 100 on a lower surface of the slider 120 to achieve insertion coupling between the sliding rail 100 and the slider 120.

The slider 120 divided into two or more members is coupled to be slidable along the sliding rail 100, thereby distributing a load applied from the upper structure mounted on the sliding rail 100 to the sliding rail 100 in the longitudinal direction of the sliding rail 100.

At the same time, a contact area of the connecting portion between the sliding rail 100 and the slider 120 may be reduced to reduce the occurrence of friction of the connecting portion, thereby reducing the driving energy consumed to move the upper structure mounted on the sliding rail 100 in the longitudinal direction of the sliding rail 100 through the actuator for bending processing of the workpiece 1.

In addition, vibration may be prevented from occurring at the contact surface between the sliding rail 100 and the slider 120, thereby improving the precision of the bending processing of the workpiece 1 and reducing the occurrence of shortening of the durability life of the fixing device 10 due to wear of the contact surface between the sliding rail 100 and the slider 120.

The slider 120 is formed of a bar-shaped member whose longitudinal width of the sliding rail 100 is formed to be larger than an axial width of the workpiece 1, and the longitudinal width of the sliding rail 100 of the slider 120 is formed to be shorter than that of the sliding rail 100 so that bending processing of the workpiece 1 may be performed according to the sliding movement of the upper structure.

In addition, the stoppers 130 are formed at both ends of the sliding rail 100 in the longitudinal direction thereof, and the stoppers 130 limit a movement distance of the panel support member 110 or the slider 120 moving along the sliding rail 100, thereby preventing separation or detachment between the sliding rail 100 and the slider 120.

On one side of the sliding rail 100 of the panel support member 110 in the longitudinal direction, lower side surfaces of a pair of fixed panels 200 formed as plate-shaped members are fixedly mounted along both sides of the workpiece 1 of the panel support member 110 in a lateral direction thereof, and the fixed panels 200 are spaced apart from each other by a lateral width size of the workpiece 1 of the panel support member 110 so that inner surfaces of the facing fixed panels 200 are parallel to each other.

An edge of the panel support member 110 of each fixed panel 200 facing the other end of the sliding rail 100 in the longitudinal direction is recessed to form a semicircle so that a first opening 201 is formed.

A tilting shaft 111 having a circular cross-sectional shape is mounted at the center of the panel support member 110 to pass through both sides of the workpiece 1 in the lateral direction, and the tilting shaft 111 is disposed to be parallel to the axial direction of the workpiece 1.

A pair of tilting panels 300 formed as plate-shaped members are disposed at a position of the other end of the sliding rail 100 of the panel support member 110 that is relatively in the longitudinal direction with respect to the fixed panel 200, and the tilting panels 300 are spaced apart by a width interval of a size corresponding to a separation interval between the fixed panels 200 in the axial direction of the workpiece 1 so that inner surfaces of the facing tilting panels 300 are parallel to each other.

A number of fixed panel interval maintenance members and tilting panel interval maintenance members may be mounted on the inner surfaces facing each other between the fixed panels 200 on both sides and the tilting panels 300 on both sides and the tilting panels 300, respectively, and the strength of the fixed and tilting panels 200 and 300 that support the rotary plate 400 may be improved through the fixed and tilting panel interval maintenance members, thereby improving the dimensional precision of the bending processing of the workpiece 1.

An edge of each tilting panel 300 facing one end of the sliding rail 100 of the panel support member 110 in the longitudinal direction is recessed to form a semicircle so that the second opening 301 is formed and the second opening 301 has a shape symmetrical to the first opening 201.

At each of lower ends of both tilting panels 300 toward the second openings 301, a tilting shaft connection hole is formed to pass through inner and outer side surfaces of each tilting panel 300 in the axial direction of the workpiece 1 and the tilting shaft 111 mounted at the center of the panel support member 110 is inserted and connected to the tilting shaft connection hole, so that the tilting panel 300 may perform a tilting operation toward the other side of the sliding rail 100 in the longitudinal direction and return to the original position using the tilting shaft 111 as a rotation center axis.

As shown in FIG. 1 and FIGS. 4 to 5, in a tilting operation original state of the tilting panel 300, upper ends of both fixed panels 200 toward the first opening 201 and upper ends of both tilting panels 300 toward the second opening 301 come into contact with each other, and lower ends of both fixed panels 200 toward the first opening 201 and lower ends of both tilting panels 300 toward the second opening 301 come into contact with each other, so that the first and second openings 201 and 301 form a circular opening.

Since, in a tilting operation state of the tilting panel 300, upper sides of a boundary portion between the first and second openings 201 and 301 are spaced apart from each other, so that an upper portion of the circular opening is open, and in the tilting operation original state of the tilting panel 300, the upper sides of the boundary portion between the first and second openings 201 and 301 come into contact with each other, so that the upper portion of the circular opening is closed. Accordingly, hereinafter, the tilting operation state of the tilting panel 300 will be defined as a closed state of the boundary portion between the first and second openings 201 and 301, and the tilting operation original state of the tilting panel 300 will be defined as an open state of the boundary portion between the first and second openings 201 and 301 in the description of the structure and operation of the fixing device 10 according to the present invention.

In the state where a boundary portion between the first and second openings 201 and 301 is closed, a connecting portion boundary between the fixed panel 200 and the tilting panel 300 has an inclined structure so that the interval from the tilting shaft 111 in the longitudinal direction of the sliding rail 100 increases toward an upper side from a lower side.

In addition, in order to prevent interference between a lower edge of the tilting panel 300 and the panel support member 110 when the tilting operation of the tilting panel 300 is performed by the opening of the boundary portion between the first and second openings 201 and 301, the lower edge of the tilting panel 300 is formed to have an inclined slope so that the interval from the upper surface of the panel support member 110 increases as the lower edge is further away from the tilting shaft 111.

The inclined slope of the lower edge of the tilting panel 300 provides a free space between facing portions between the lower end of the tilting panel 300 and the upper surface of the panel support member 110 when the tilting operation of the tilting panel 300 is performed.

The tilting operation of the tilting panel 300 is performed by the operation of a second actuator 502 mounted on the tilting panel 300, and the second actuator 502 is mounted on the tilting panel 300.

When the boundary portion between the first and second openings 201 and 301 is closed, the rotary plate 400 having a circular disk shape is inserted into the circular opening formed by the first and second openings 201 and 301 to be rotatable around the axial direction of the workpiece 1, and the rotary plate 400 has a structure in which a first rotary plate 401 and a second rotary plate 402, which are members having a semicircular cross-sectional shape, are separably connected to each other.

A clamp 420 for fixing the outer peripheral surface of the workpiece 1 is formed at a semicircular center edge of each of the first and second rotary plates 401 and 402, the rotary plate 400 rotates around a central axis of the workpiece 1 fixed to the clamps 420 on both sides in the state where the boundary portion between the first and second openings 201 and 301 is closed, and the outer peripheral surface of the rotary plate 400 and the circular openings formed by the first and second openings 201 and 301 are concentric with each other.

On outer peripheral surfaces of the first and second rotary plates 401 and 402, a driven gear 410 including a number of gear teeth disposed at a certain angle and height is formed, so that in the state where the boundary portion between the first and second openings 201 and 301 is closed, the rotary plates 400 form a spur gear-shaped structure.

A drive gear 430 formed as a spur gear engages with the driven gear 410 on the outer peripheral surface of the rotary plate 400, and both ends of a rotating shaft of the drive gear 430 on both sides are connected to both fixed panels 200 or both tilting panels 300, so that the drive gear 430 is positioned between both fixed panels 200 or both tilting panels 300.

A first actuator 501 that provides a rotational driving force to the drive gear 430 is connected to the rotating shaft of the drive gear 430, and the driving force of the first actuator 501 is transmitted through the drive gear 430 and the driven gear 410 to rotate the workpiece 1 fixed to the rotary plate 400 and the clamp 420.

A third actuator 503 is mounted at an end of the panel support member 110, and the third actuator 503 slides the panel support member 110 in the longitudinal direction of the sliding rail 100 so that the bending processing of the workpiece 1 in the longitudinal direction of the sliding rail 100 is performed.

The workpiece 1 may be formed so that a number of curved sections are formed in the shape of a finished product, such as a stabilizer bar that constitutes a suspension of a vehicle and a direction of the curves is continuously changed in a direction according to a three-dimensional coordinate system.

Therefore, when the workpiece 1 is fixed between the clamps 420 on both sides in the state where the boundary portion between the first and second openings 201 and 301 is closed, i) by moving in the longitudinal direction of the sliding rail 100 by the operation of the third actuator 503, or ii) by causing the workpiece 1 to rotate in the axial direction and move in the longitudinal direction of the sliding rail 100 at the same time according to the operation of the first and third actuators 501 and 503, bending processing of the complexly curved workpiece 1 is performed.

During the bending processing of the workpiece 1 in the longitudinal direction of the sliding rail 100 through the third actuator 503, the direction in which the bending processing is performed in the axial direction of the workpiece 1 may be changed by rotating the workpiece 1 by a certain angle through the first actuator 501.

Accordingly, it is possible to perform the bending processing of the workpiece 1 having a shape in which a number of curved sections are formed or the direction of the curves is continuously changed according to the direction of the three-dimensional coordinate system.

In order to perform the bending processing of the workpiece 1, the workpiece 1 is fixedly mounted using the clamp 420, or in order to separate the workpiece 1 on which the bending processing is completed from the clamp 420, the tilting panel 300 is tilted by operating the second actuator 502, thereby opening the boundary portion between the first and second openings 201 and 301.

In the state where the boundary portion between the first and second openings 201 and 301 is open, the upper portion of the boundary portion between the first and second openings 201 and 301 is separated so that the upper portion of the circular opening is opened, and the workpiece 1 is introduced or separated and taken out through an open gap in the upper portion of the circular opening.

In this case, since the rotary plate 400 is divided into two members including the first and second rotary plates 401 and 402, a connecting portion boundary of the first and second rotary plates 401 and 402 has to be opened together so that the clamp 420 formed at the semicircular center edge of each of the first and second rotary plates 401 and 402 may be exposed through the open gap of the first and second openings 201 and 301.

Therefore, in order to allow the connecting portion boundary of the first and second rotary plates 401 and 402 to be opened together in the state where the boundary portion between the first and second openings 201 and 301 is open by the tilting operation of the tilting panel 300, it is necessary to dispose a connecting portion boundary surface between the fixed panel 200 and the tilting panel 300 and a connecting portion boundary surface between the first and second rotary plates 401 and 402 on the same plane by rotating the rotary plate 400 at a specific angle by the operation of the first actuator 501.

In addition, due to the structural characteristics of the rotary plate 400 forming a spur gear engaging with the drive gear 430, free rotation has to occur inside the circular opening formed by the first and second openings 201 and 301 in the closed state, and at the same time, the first and second rotary plates 401 and 402 need to be restrained from being separated from the first opening 201 or the second opening 301 in the state where the boundary portion between the first and second openings 201 and 301 is open.

Therefore, as shown in FIG. 6, a rotation guide groove 202 may be formed in one or both of inner surfaces of the fixed panel 200 and the tilting panel 300 facing each other, and the rotation guide groove 202 is formed as a recessed groove that forms a circular ring shape when the upper ends of the fixed panel 200 and the tilting panel 300 come into contact with each other in the state where the first and second openings 201 and 301 are closed.

In the rotary plate 400 in which the first and second rotary plates 401 and 402 are in a combined state, a rotation guide rim 403 that protrudes to form a circular ring shape is formed on a surface facing the rotation guide groove 202, and the rotation guide rim 403 is rotatably inserted into the rotation guide groove 202.

A diameter of an outer peripheral surface of the semicircular ring of the rotation guide rim 403 formed on the first and second rotary plates 401 and 402 is smaller than a diameter of a bottom of gear teeth of the driven gear 410 formed on the first and second rotary plates 401 and 402, and a diameter of each of the first and second openings 201 and 301 of the fixed panel 200 and the tilting panel 300 is smaller than a diameter an inner peripheral surface of the semicircular ring of the rotation guide rim 403 formed on the first and second rotary plates 401 and 402.

A depth and a width of the groove of the rotation guide groove 202 are formed to be larger than a height and a width of the protrusion of the rotation guide rim 403 so that the rotary plate 400 is rotated according to the operation of the first actuator 501 and the rotation guide groove 202 maintains the position of a center point of a rotation axis of the rotary plate 400 constant while guiding the rotation of the rotation guide rim 403.

As the position of the center point of the rotary plate 400 is constantly formed, the change in the position of the center axis of the workpiece 1 excluding the movement of a rotation center axis of the workpiece 1 according to the operation of the third actuator 503 is prevented, thereby improving the precision of the bending processing of the workpiece 1.

In addition, as shown in FIGS. 7 and 8, in order to prevent the position of the rotation center axis of the rotary plate 400 from changing as the rotary plate 400 tilts downward by a tolerance size formed in the rotation guide groove 202 and the rotation guide rim 403 due to the weight of the rotary plate 400 or to prevent vibration from occurring due to friction between an inner surface of the rotation guide groove 202 and an outer surface of the rotation guide rim 403, the rotation guide rim 403 forms a structure supported by a number of pulleys 203.

The pulleys 203 are rotatably mounted on a pulley mounting groove formed to be recessed in an outer side of a surface in which the rotation guide groove 202 of the fixed panel 200 or the tilting panel 300 is formed, and rotating shafts of the pulleys 203 are radially disposed at a certain interval from the center of the rotation guide groove 202.

An outer peripheral surface of each pulley 203 comes into contact with the outer peripheral surface of the rotation guide rim 403 to support the rotation guide rim 403, and when the rotary plate 400 rotates, the pulleys 203 rotate together, thereby reducing vibration generated in the rotary plate 400, and preventing the rotary plate 400 from tilting downward due to its own weight, so that the position of the rotation center axis of the rotary plate 400 is maintained constant.

As shown in FIGS. 9 and 10, a first connecting shaft connection hole is formed on an edge of the tilting panel 300 facing the third actuator 503, and the first connecting shaft connection hole may be formed integrally on the tilting panel 300 or formed on a member that is fixedly attached to the tilting panel 300.

In the panel support member 110, a second connecting shaft connection hole is formed to be disposed between the tilting shaft 111 and the third actuator 503, and first and second connecting shafts 302 and 112 are inserted into and fixed to the first and second connecting shaft connection holes, respectively.

An upper end of the second actuator 502 is rotatably connected to the first connecting shaft 302, and a lower end of the second actuator 502 is rotatably connected to the second connecting shaft 112.

As the second actuator 502 is operated, the tilting panel 300 tilts or returns to its original position, the boundary portion between the first and second openings 201 and 301 is open or closed, and in the process of opening or closing the boundary portion between the first and second openings 201 and 301, connection angles between the tilting panel 300 and the second actuator 502, and between the second actuator 502 and the panel support member 110 are changed.

In addition, the clamp 420 formed on each of the first and second rotary plates 401 and 402 may be configured such that a sliding bar 422 is inserted into a sliding groove 421 formed as a groove formed to be recessed into the outer peripheral surface of the rotary plate 400 at the semicircular center edges of the first rotary plate 401 and the second rotary plate 402 to be slidable toward or away from the center point of the rotary plate 400.

At an end of each sliding bar 422 toward the center point of the rotary plate 400, a grip portion 423 for fixing the workpiece 1 is formed, and as shown in FIG. 11, each grip portion 423 is formed so that the width of the workpiece 1 in the axial direction is greater than a vertical height, and at ends of the grip portions 423 on both sides facing each other, a V-shaped concave groove having a depth that changes in the vertical direction is formed.

The cross-sectional shape of the grip portion 423 as described above increases the length of a grip formed between the grip portion 423 and the workpiece 1 in the axial direction of the workpiece 1 and improves a grip force of the grip portion 423 for preventing a change in a grip angle of the workpiece 1 against a twisting force acting on the workpiece 1 during the bending processing of the workpiece 1, thereby improving the precision of the bending processing of the workpiece 1.

In this case, in order to further improve the grip force of the grip portion 423, it is preferable to form a direction in which an external force is applied to the workpiece 1 to perform the bending processing of the workpiece 1 to be parallel to an opposing disposition direction between the grip portions 423 on both sides.

A concave-shaped elastic member fixing groove 425 is formed to be recessed on each of inner surfaces of the sliding grooves 421 of the first and second rotary plates 401 and 402 facing each other and on an opposite end of the grip portion 423 of each sliding bar 422, and both ends of an elastic member 424 are inserted into and fixed to the elastic member fixing grooves 425 of the sliding groove 421 and the sliding bar 422 facing each other.

The elastic member 424 firmly fixes the workpiece 1 by deflecting each sliding bar 422 toward the center of the first and second rotary plates 401 and 402, and supports and fixes the workpiece 1 by compressing or stretching the elastic member 424 in response to a diameter size of the workpiece 1 fixed to the clamp 420, thereby allowing the bending processing of the workpieces 1 of various specifications.

The sliding groove 421 of each of the first and second rotary plates 401 and 402 may have a concave groove shape with both sides open in the axial direction of the workpiece 1, and guide panels 426 may be detachably mounted on open surfaces of the first and second rotary plates 401 and 402 on both sides in the axial direction of the workpiece 1.

The guide panel 426 closes the open side of the sliding groove 421 to guide the sliding bar 422 in the direction of movement so that the sliding bar 422 may move in a straight line in a depth direction of the sliding groove 421, and prevents the sliding bar 422 from detaching through the open side.

In this case, an end edge of the sliding groove 421 of the guide panel 426 in a direction of recession may be mounted to be spaced a certain interval from an inner surface of the sliding groove 421 where the elastic member fixing groove 425 is formed toward the center of the rotary plate 400, and clamp stoppers 427 having surfaces partially protruding in the axial direction of the workpiece 1 may be formed on surfaces at both ends of a formation portion of the elastic member fixing groove 425 of the sliding bar 422 in the longitudinal direction of the sliding rail 100.

The clamp stopper 427 prevents the sliding bar 422 from being separated from the sliding groove 421 by being caught on a side surface of the guide panel 426 when the length of the elastic member 424 is stretched by elastic restoration of the elastic member 424.

In addition, by providing a space in which the sliding bar 422 may slide along the sliding groove 421 by the spacing between the guide panel 426 and the inner surface of the sliding groove 421, it is possible to support and fix the workpiece 1 through the grip portion 423 corresponding to diameter sizes of the workpieces 1 of various specifications.

The size of the grip force of the grip portion 423 for supporting and fixing the workpiece 1 may be controlled by changing the type of elastic member 424 mounted between the sliding groove 421 and the sliding bar 422, and by mounting the elastic member 424 having a different elastic coefficient according to a required grip force of the grip portion 423, an appropriate level of grip force is provided.

In addition, the clamp 420 of the fixing device 10 according to the present invention is configured without a separate actuator for controlling gripping and releasing of the workpiece 1 mounted on the side surface of the rotary plate 400, thereby reducing the thickness of the workpiece 1 of the fixing device 10 in the axial direction compared to conventional fixing devices.

Accordingly, the maximum approachable distance that the bending device of the workpiece 1 may move toward the grip portion 423 of the fixing device 10 in the process of performing the bending processing may be lowered, and by lowering the minimum bendable length limit of the workpiece 1, the shape or size limit of the finished shaft-shaped product capable of being bent may be eased.

In addition, by disposing the first actuator 501 for rotating the workpiece 1 fixed to the clamp 420 and the second actuator 502 for tilting the tilting panel 300 at a position spaced a certain distance from the central axis of the workpiece 1, it is possible to form a structure capable of lowering the minimum bendable length limit by preventing interference with the bending device approaching the fixing device 10.

The process of performing bending processing of the workpiece 1 using the fixing device 10 of the present invention configured as described above includes an operation of fixing and disposing the workpiece 1, an operation of performing bending processing of the workpiece 1, and an operation of separating the workpiece 1.

As shown in FIG. 14, in a state where the rotary plate 400 is rotated by a specific angle by the operation of the first actuator 501 so that the connecting portion boundary of the first and second openings 201 and 301 of the fixed panel 200 and the tilting panel 300 and the connecting portion boundary of the first and second rotary plates 401 and 402 coincide with each other, as the second actuator 502 performs a contraction direction operation, the tilting panel 300 tilts to open the boundary portion between the first and second openings 201 and 301, and the operation of fixing and disposing the workpiece 1 is performed in the state where the boundary portion between the first and second openings 201 and 301 is open.

The workpiece 1 is introduced between the first and second rotary plates 401 through the open side surfaces of the first and second openings 201 and 301 and the fixed panel 200 and the tilting panel 300, so that the workpiece 1 is positioned between the clamps 420 on both sides, and then, when the second actuator 502 performs a stretch direction operation, the tilting panel 300 returns to its original position and the clamps 420 on both sides firmly fix the outer peripheral surface of the workpiece 1.

Then, in the operation of performing bending processing of the workpiece 1, as shown in FIGS. 12 and 13, the bending processing of bending the workpiece 1 fixed to the rotary plate 400 while moving the workpiece 1 in the longitudinal direction of the sliding rail 100 is performed by the operation of the third actuator 503, and the bending direction of the workpiece 1 is changed by operating the first actuator 501 according to the position and bending direction of curved portions of the workpiece 1.

The bending processing on the workpiece 1 by the operation of the third actuator 503 and the changing of the bending direction of the workpiece 1 by the operation of the first actuator 501 may be performed separately or simultaneously depending on the shape of the finished product of the workpiece 1.

The bending processing for each position of the workpiece 1 in the longitudinal direction of the sliding rail 100 is performed by moving a bending device (not shown in the drawing) in the axial direction of the workpiece 1, and when the workpiece 1 has a shape that is symmetrical along the axial direction, two bending devices are disposed on both sides of the fixing device 10 in the axial direction of the workpiece 1 and the bending processing is performed in the direction in which the bending devices approach the fixing device 10, thereby improving the precision of the bending processing of the workpiece 1.

When the operation of performing bending processing of the workpiece 1 is completed, the operation of separating the workpiece 1 is performed, and in the operation of separating the workpiece 1, the rotary plate 400 is rotated by a specific angle by the operation of the first actuator 501 to align the connecting portion boundary of the first and second openings 201 and 301 of the fixed panel 200 and the tilting panel 300 with the connecting portion boundary of the first and second rotary plates 401 and 402.

Then, as the second actuator 502 performs the contraction direction operation, the tilting panel 300 is tilted, and as the boundary portion between the first and second openings 201 and 301 is opened, the state where the workpiece 1 is fixed by the clamp 420 is released.

When the fixation of the workpiece 1 is released, the workpiece 1 is separated from the clamp 420 and the workpiece 1 is taken out through the first and second openings 201 and 301 and the open side of the fixed panel 200 and the tilting panel 300, thereby finishing the bending processing process of the workpiece 1.

According to an embodiment of the present invention, by forming a structure in which a separate actuator for controlling gripping and releasing of a workpiece to a clamp is not added, an axial thickness of the workpiece of the fixing device can be reduced, and a minimum bendable length limit of the workpiece can be lowered by reducing a maximum approachable distance in which a bending device is movable toward a gripping portion, thereby easing shape or size limits of a finished shaft-shaped product capable of being subjected to bending processing.

According to an embodiment of the present invention, by distributing a load acting on a sliding rail through a slider divided into two or more members in a longitudinal direction of the rail, and at the same time, reducing a contact surface at a connecting portion between the sliding rail and the slider to reduce friction at the connecting portion by supporting an upper structure mounted on the sliding rail, driving energy consumed in bending processing can be reduced and vibration at the contact surface between the sliding rail and the slider can be prevented, thereby improving the precision of the bending processing.

According to an embodiment of the present invention, by controlling a tilting operation of a tilting panel according to the operation of a second actuator to control coupling and separation of first and second rotary plates, and performing gripping or releasing of a workpiece through a clamp formed at a boundary of a coupling surface between the first and second rotary plates, a time required for fixing or separating the workpiece can be shortened, thereby improving the efficiency of bending processing.

Therefore, it should be understood that the embodiments described above are illustrative and not restrictive in all respects, the scope of the present invention described in the detailed description above is indicated by the claims described below, and all changes or modifications derived from the meaning and scope of the claims and their equivalent concepts should be interpreted as being included in the scope of the present invention.

What is claimed is:

1. A fixing device for bending processing of a shaft-shaped member, comprising:

a sliding rail (100) disposed in a direction perpendicular to an axial direction of a workpiece (1) having a shaft shape;

a panel support member (110) disposed on an upper side of the sliding rail (100) to be slidable in a longitudinal direction of the sliding rail (100);

a fixed panel (200) including a pair of plate-shaped members fixedly disposed on one side of the panel support member (110) in the longitudinal direction of the sliding rail (100) to be spaced a certain interval apart in the axial direction of the workpiece (1), and a first opening (201) formed so that an edge facing a tilting panel (300) is recessed to form a semicircle;

a tilting shaft (111) mounted parallel to the axial direction of the workpiece (1) at a center of the panel support member (110);

the tilting panel (300) including a pair of plate-shaped members disposed on the other side of the panel support member (110) in the longitudinal direction of the sliding rail (100) to be spaced a predetermined interval apart in the axial direction of the workpiece (1), including a second opening (301) formed to be recessed in a semicircular shape in which an edge facing the fixed panel (200) is symmetrical to the first opening (201), and having a lower end toward the second opening (301) connected to be tiltable around the tilting shaft (111);

a rotary plate (400) having a circular disk shape formed by detachably coupling first and second rotary plates (401 and 402) of a semicircular cross-sectional shape to each other to be inserted to be rotatable in the axial direction of the workpiece (1) inside the circular openings formed by the first and second openings (201, 301), having a driven gear (410) formed on an outer peripheral surface thereof, and having a clamp (420) formed to fix an outer peripheral surface of the workpiece (1) to a semicircular central edge of each of the first and second rotary plates (401 and 402);

a drive gear (430) configured to engage with the driven gear (410) on the outer peripheral surface of the rotary plate (400);

a first actuator (501) configured to provide a rotational driving force to the drive gear (430) to rotate the workpiece (1) fixed to the rotary plate (400) and the clamp (420);

a second actuator (502) mounted on the tilting panel (300) and configured to tilt the tilting panel (300) around the tilting shaft (111) to open or close a boundary portion between the first and second openings (201 and 301); and a third actuator (503) mounted at an end of the panel support member (110) and configured to cause the panel support member (110) to slide in the longitudinal direction of the sliding rail (100).

2. The fixing device of claim 1, wherein the bending processing is performed when the workpiece (1) fixed to the clamp (420) moves in the longitudinal direction of the sliding rail (100) by operating the third actuator (503) or rotates and moves at the same time by operating the first and third actuators (501 and 503) in a state where the boundary portion between the first and second openings (201 and 301) is closed, the workpiece (1) is fixedly mounted on or separated from the clamp (240) in a state where the boundary portion between the first and second openings (201 and 301) is open, and an operation of opening or closing the boundary portion between the first and second openings (201 and 301) is performed by operating the second actuator (502) in a state where the rotary plate (400) is rotated so that a connecting portion boundary between the fixed panel (200) and the tilting panel (300) and a connecting portion boundary between the first and second rotary plates (401 and 402) are disposed on the same plane by operating the first actuator (501).

3. The fixing device of claim 1, wherein, in a state where the boundary portion between the first and second openings (201 and 301) is closed, a connecting portion boundary between the fixed panel (200) and the tilting panel (300) is inclined so that an interval from the tilting shaft (111) in the longitudinal direction of the sliding rail (100) increases toward an upper side from a lower side, and a lower edge of the tilting panel (300) forms an inclined surface in which an interval from an upper surface of the panel support member (110) increases as the lower edge is further away from the tilting shaft (111).

4. The fixing device of claim 1, wherein the clamp (420) includes:

a sliding groove (421) formed at each of the semicircular central edges of the first and second rotary plates (401 and 402) and formed as a groove formed to be recessed into the outer peripheral surface of the rotary plate (400);

a pair of sliding bars (422) inserted into the sliding grooves (421) of the first and second rotary plates (401 and 402) to slide along the sliding grooves (421), and having a grip portion (423) formed at ends of central portions of the first and second rotary plates (401 and 402) to fix the workpiece (1); and an elastic member (424) having both ends fixed to an inner surface of each of the sliding grooves (421) of the first and second rotary plates (401 and 402) facing each other and an end of the sliding bar (422), and configured to biasedly move each sliding bar (422) toward the central portions of the first and second rotary plates (401 and 402).

5. The fixing device of claim 1, wherein a rotation guide groove (202) recessed to form a circular ring shape in a state where the first and second openings (201 and 301) are closed is formed in one or both of inner surfaces facing each other between the fixed panel (200) and the tilting panel (300), and a rotation guide rim (403) that protrudes to form a semicircular ring shape and is rotatably inserted into the rotation guide groove (202) is formed on each of surfaces of the first and second rotary plates (401 and 402) facing the rotation guide groove (202).

6. The fixing device of claim 1, wherein an upper end of the second actuator (502) is rotatably connected to a first connecting shaft (302) mounted on an edge of the tilting panel (300) facing the third actuator (503), and a lower end of the second actuator (502) is rotatably connected to a second connecting shaft (112) mounted on the panel support member (110) to be disposed between the tilting shaft (111) and the third actuator (503).

7. The fixing device of claim 1, wherein a plurality of sliders (120) coupled to be slidable on the sliding rail (100) are fixedly mounted on a lower surface of the panel support member (110).

8. The fixing device of claim 4, wherein the sliding grooves (421) of the first and second rotary plates (401 and 402) form a concave groove shape that is open in the axial direction of the workpiece (1), an elastic member fixing groove (425) in the shape of a concave groove into which an end of the elastic member (424) is inserted and fixed is formed in surfaces of ends of each sliding bar (422) and the opposing sliding groove (421) facing each other, and a guide panel (426) configured to close an open portion of the sliding groove (421) and guide a moving direction of the sliding bar (422) is mounted on each of surfaces of the first and second rotary plates (401 and 402) in the axial direction of the workpiece (1).

9. The fixing device of claim 5, wherein a number of pulleys (203) are rotatably mounted on an outer side of a surface forming the rotation guide groove (202) of the fixed panel (200) or the tilting panel (300) to be spaced a certain interval from a center of the rotation guide groove (202) and radially disposed, and an outer peripheral surface of each pulley (203) supports an outer peripheral surface of the rotation guide rim (403).

10. The fixing device of claim 7, wherein stoppers (130) for limiting a movement distance of the panel support member (110) are formed at both ends of the sliding rail (100) in the longitudinal direction.

11. The fixing device of claim 8, wherein a clamp stopper (427) is formed at an end of a formation portion of the elastic member fixing groove (425) of the sliding bar (422) so that a portion of a surface of the sliding bar (422) protrudes in the axial direction of the workpiece (1), and a catch occurs between the clamp stopper (427) and the guide panel (426) when the elastic member (424) is stretched by elastic restoration.

* * * * *